US012024881B1

(12) United States Patent
Laydera-Collins

(10) Patent No.: US 12,024,881 B1
(45) Date of Patent: Jul. 2, 2024

(54) TELESCOPING WALL GAP FILLER ASSEMBLY

(71) Applicant: Gordon Sales, Inc., Bossier City, LA (US)

(72) Inventor: Imack Laydera-Collins, Benton, LA (US)

(73) Assignee: Gordon Sales, Inc., Bossier City, LA (US)

( * ) Notice: Subject to any disclaimer, the term of this patent is extended or adjusted under 35 U.S.C. 154(b) by 230 days.

(21) Appl. No.: 17/580,445

(22) Filed: Jan. 20, 2022

Related U.S. Application Data

(60) Provisional application No. 63/190,851, filed on May 20, 2021, provisional application No. 63/139,465, filed on Jan. 20, 2021.

(51) Int. Cl.
*E04B 1/68* (2006.01)
*E04B 1/82* (2006.01)
*E04B 2/56* (2006.01)

(52) U.S. Cl.
CPC ..... *E04B 1/6815* (2013.01); *E04B 1/82* (2013.01); *E04B 2/56* (2013.01)

(58) Field of Classification Search
CPC . E04B 1/6815; E04B 1/82; E04B 2/56; E04B 2/90; E04B 2/82
See application file for complete search history.

(56) References Cited

U.S. PATENT DOCUMENTS

| | | | | |
|---|---|---|---|---|
| 3,292,321 | A * | 12/1966 | Vander Schans | E04B 2/822 52/241 |
| 3,386,216 | A * | 6/1968 | Zwickert | E04B 2/821 49/504 |
| 3,967,420 | A * | 7/1976 | Papsco | E04F 21/1894 52/745.1 |
| 4,086,734 | A * | 5/1978 | Hayashi | E04B 2/821 52/243.1 |
| 4,205,498 | A * | 6/1980 | Unayama | E04B 2/822 52/243.1 |
| 5,524,402 | A * | 6/1996 | Sykes | E04B 2/82 52/241 |
| 6,351,915 | B1 * | 3/2002 | Puckett | E04B 2/96 52/235 |
| 8,572,914 | B2 | 11/2013 | Burgess | |
| 8,782,977 | B2 | 7/2014 | Burgess | |
| 10,494,811 | B1 * | 12/2019 | Gussenbauer | E04B 2/827 |
| 11,486,137 | B2 * | 11/2022 | Klein | E04B 1/948 |
| 2002/0157335 | A1 * | 10/2002 | Vos | E04B 2/821 52/239 |
| 2004/0216398 | A1 * | 11/2004 | Manos | E04B 9/18 52/167.7 |
| 2012/0180414 | A1 * | 7/2012 | Burgess | E04B 2/90 52/300 |

(Continued)

*Primary Examiner* — Gisele D Ford
(74) *Attorney, Agent, or Firm* — Jones Walker LLP

(57) ABSTRACT

A gap filler assembly for filling or covering a gap between an interior partition wall and an exterior wall of a building. Two slidingly engaged frame members define an interior cavity that has a variable volume. Disposed within the interior cavity is a biasing member configured to exert a force on a first frame member in a direction away from a second frame member for compressing the frame members between the interior partition wall and the exterior wall. The biasing member may be a spring or an expanding foam sound insulation.

8 Claims, 19 Drawing Sheets

(56) References Cited

U.S. PATENT DOCUMENTS

| | | | | |
|---|---|---|---|---|
| 2017/0234004 | A1* | 8/2017 | Pilz | E04B 2/7457 52/232 |
| 2019/0218774 | A1* | 7/2019 | Danesi | E04B 2/7401 |
| 2019/0316348 | A1* | 10/2019 | Pilz | E04B 1/24 |
| 2021/0108410 | A1* | 4/2021 | Pring | E04B 2/825 |
| 2021/0363750 | A1* | 11/2021 | Picchio | E04B 2/821 |
| 2022/0098888 | A1* | 3/2022 | Richard | E04H 9/021 |

* cited by examiner

TELESCOPING WALL GAP FILLER ASSEMBLY

CROSS-REFERENCE TO RELATED APPLICATIONS

The application claims the benefit of and priority to U.S. Provisional Patent Application No. 63/139,465 filed on Jan. 20, 2021 and U.S. Provisional Patent Application No. 63/190,851 filed on May 20, 2021, each of which is incorporated herein by reference in its entirety.

FIELD OF THE INVENTION

The present invention relates to the architectural and building construction industries, and more particularly to structures designed to fill gaps between walls and windows, partition walls and perimeter walls, and the like, for purposes of privacy and reduction of sound transmission from separated spaces.

BACKGROUND

Modern commercial buildings are designed to fit a diversity of rooms and partition arrangements aiming to accommodate specific requirements for occupants. As such, when adding partitions there are conditions that won't allow for partition walls to be built in direct contact with exterior windows or exterior structures. Many commercial buildings have an exterior facade composed of large glass windows supported by a metallic structure or frame. The metallic structure typically includes vertical and horizontal members known in the industry as window mullions. Many builders select the position of the vertical window mullions for interior partition walls in order to avoid ending the partition walls facing a glass pane, which would diminish the outside aesthetic of the building facade. The wall is aligned with the vertical window mullion. Since in many instances, the wall cannot be extended to be in contact with the window mullion, the gap is filled with an elongated structure that covers the gap between the window mullion and the partition wall end, or between the window pane and the partition wall end. These gap fillers achieve two purposes: (1) to create an aesthetically pleasant joint, and (2) to prevent transmission of sound through the gap. Since the window frame has motion due to the external wind force, there is motion of the frame relative to the partition wall, which is the reason for which the gap filling element must have some degree of elasticity to allow the frame motion without adding additional loads to the partition walls. Some manufacturers use a foam type element that is wedged into the gap. Others make rigid elements that are custom made for specific gaps or are attached to the faces of the wall projecting into the gap.

Due to the diverse configuration of curtain walls and window frames, there is a need for a gap filler that is resilient, aesthetically pleasant and capable of blocking the noise transmission from room to room for privacy requirements.

SUMMARY

The present invention relates to an architectural gap filler that is resilient and configured to fit in a range of gap openings. It may also be aesthetically pleasant, durable, easy to install, and capable of substantially blocking the sound transmission through the gap.

The gap filler assembly of the present invention includes at least two frame members that cooperate with each other to define an interior cavity that has a variable volume. In one embodiment, compression springs are disposed within the interior cavity, which is otherwise filled with a sound absorbing insulation. The compression springs push the two frame members in an outward direction. Because the insulation inside the interior cavity is compressed when the frame members are compressed, the insulation fully recovers from the compressed condition to a free state that fills the volume of the interior cavity in the relaxed state. To be able to achieve this result, the gap filler assembly of the present invention utilizes a combination of rigid or semi-rigid insulation material with resilient insulation material.

In a second embodiment, the interior cavity is filled with a sound insulating foam, which pushes the two shells outwardly. For example, the sound insulating foam of this embodiment may include an expanding foam sound insulation. Since the insulating foam inside the interior cavity is compressed when the frame members are compressed, the insulating foam fully recovers from the compressed condition to a different compression state while applying a predetermined pressure to force the two frame members to conform to the width of any wall to window gaps or wall to wall gaps. In applications involving filling larger gaps, combinations of rigid or semi-rigid insulation with insulating foam may be utilized to assure that the recovery force of the foam under compression is limited to certain values.

Since the two frame members of the gap filler assembly are urged to separate outwardly by internal springs or by expanding foam, the resulting force or pressure is exerted over the vertical boundaries of the gap along the interior and exterior walls to secure the assembly inside the gap. The gap filler assembly contains resilient gaskets at the end faces, which contact the vertical boundaries of the gap to make sure both surfaces are tightly sealed. The gaskets may also include contact adhesive at each gasket's face to further ensure their position within the gap.

In one application for filling gaps between the end of partition walls and the adjacent window mullion, the frame members are placed in contact with the window mullion and the end cap of the partition wall. In other applications, a narrower gap filler assemblies can be positioned on both sides of the window mullions. In such applications, the gap filler assemblies fit within the thickness of the partition wall facing the window mullion. To further seal any gaps around the opening, caulking paste may be placed at the edges of the elongated elements.

Other objects, advantages and variations of the present invention, will become apparent and obvious from a study of the following detailed description and accompanying drawings which are merely illustrative of such invention.

BRIEF DESCRIPTION OF THE DRAWING VIEWS

DETAILED DESCRIPTION OF SELECTED EMBODIMENTS

Disclosed herein is a gap filler assembly for use in filling a gap between an interior wall and an exterior wall or window, or between an interior wall and a window mullion along an exterior wall, in a building structure. The gap filler includes two or more frame members that are biased apart in order to position the gap filler assembly in a state of compression in the gap between the interior wall and the exterior wall or mullion. The frame members define an interior cavity having a variable volume. In some embodiments, a sound barrier material is disposed within the interior cavity. In certain embodiments, the frame members are biased apart by a spring disposed within the interior cavity. Alternatively, the frame members may be biased apart by an expanding sound insulating material, such as an expanding foam material.

Various embodiments of the gap filler assembly of the present invention are illustrated in FIGS. 1-20, with many other variations and embodiments apparent to a skilled artisan after reviewing this disclosure.

Figure 1:
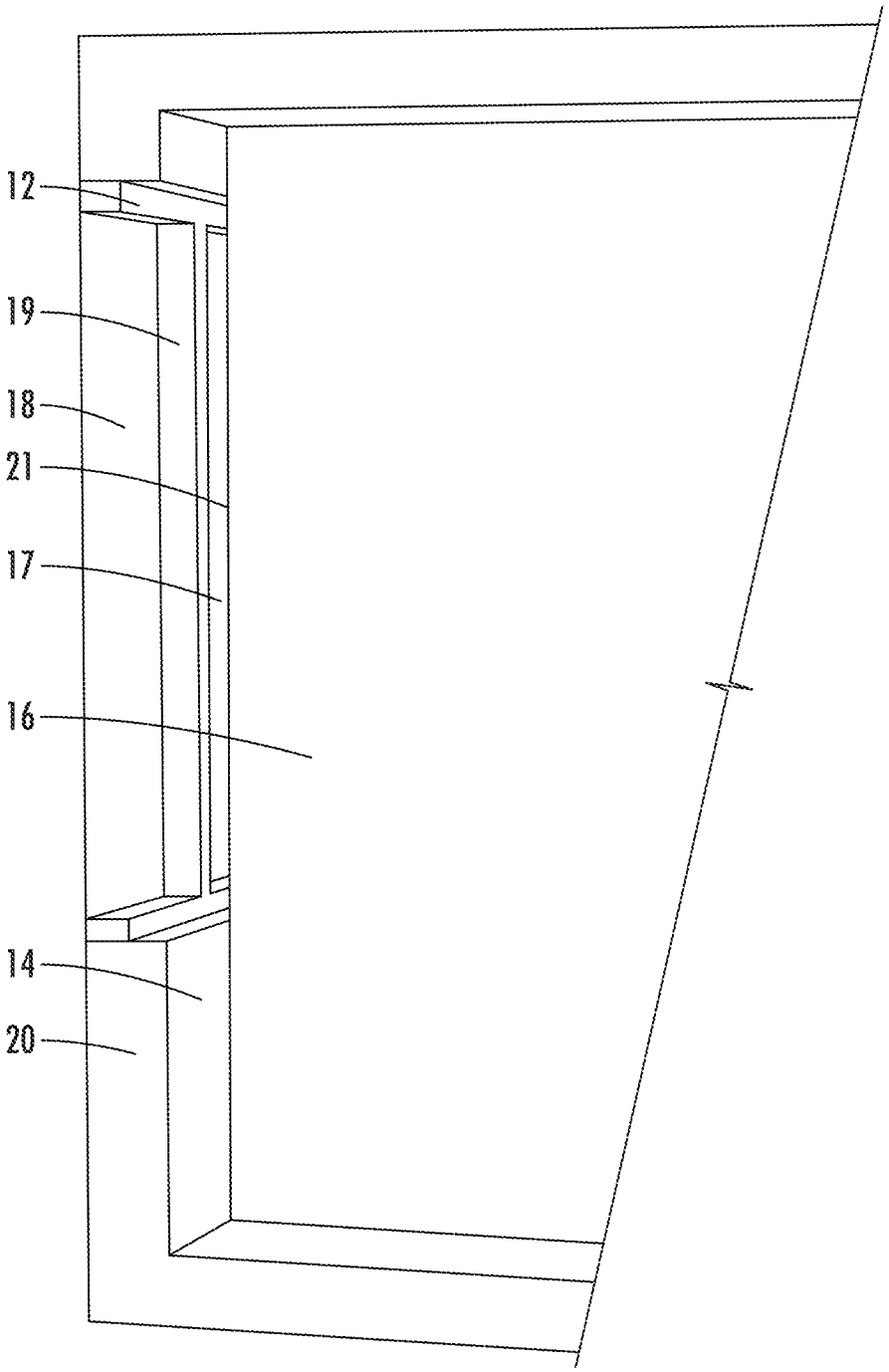
FIG. 1 PRIOR ART
FIG. 1 is a perspective view showing the application in which a gap filler assembly is used.

FIG. 1 illustrates an example of a building configuration in which a window peripheral frame or mullion 12 is attached to an exterior wall 20 above base wall 14. Glass window panes 18 are held between peripheral window mullions 12 and vertical window mullion 19. An inner partition wall 16 may be constructed to place its end face 21 in contact with the base wall 14. However, a gap 17 is left between the window mullions 19, the glass window panes 18, and end face 21 of inner partition wall 16. Gap 17 enables sound to travel between the spaces on either side of interior partition wall 16.

Figure 2:
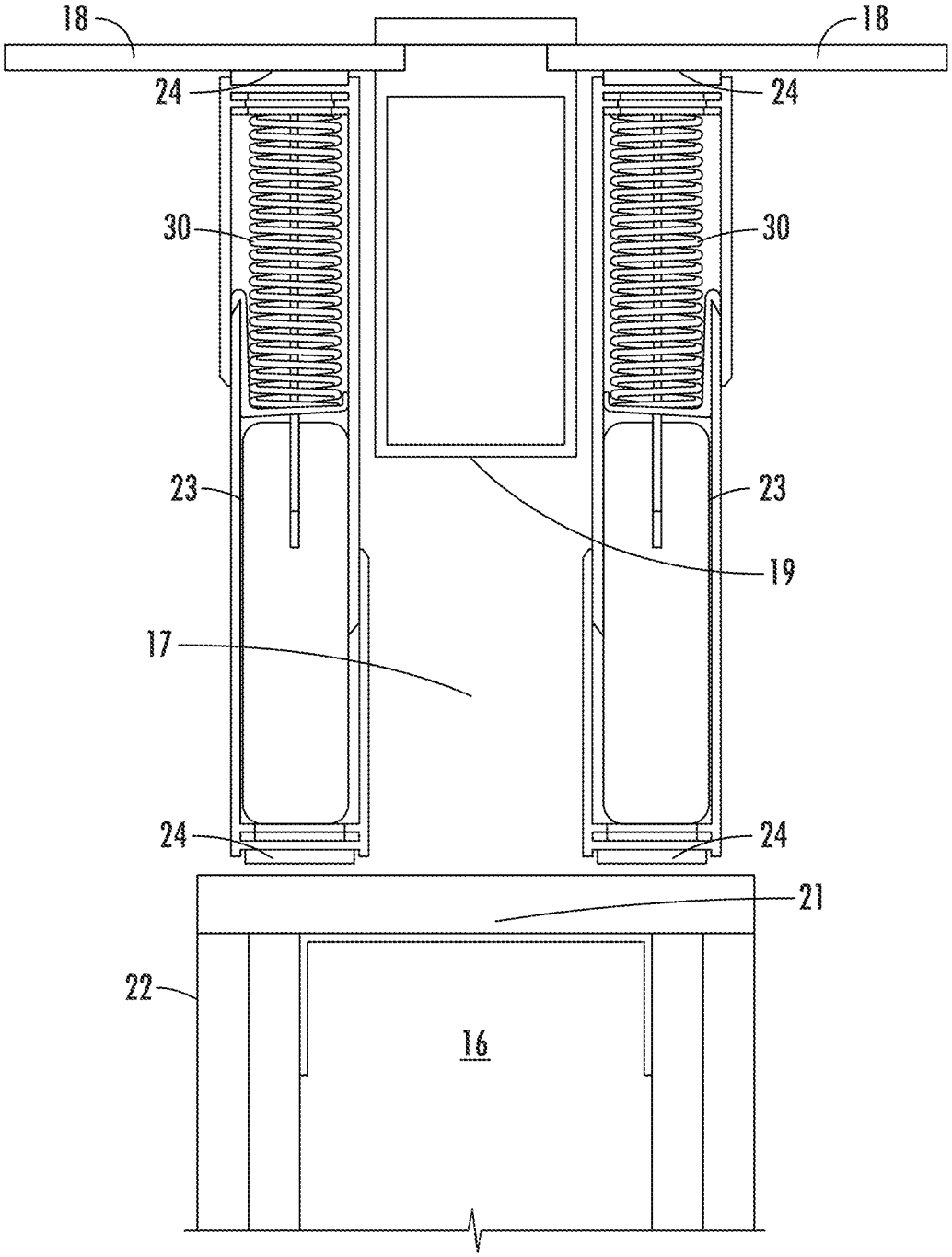
FIG. 2 is a sectional view of a gap filler assembly of the present invention in use to fill a gap between a wall and a window mullion.
Figure 3:
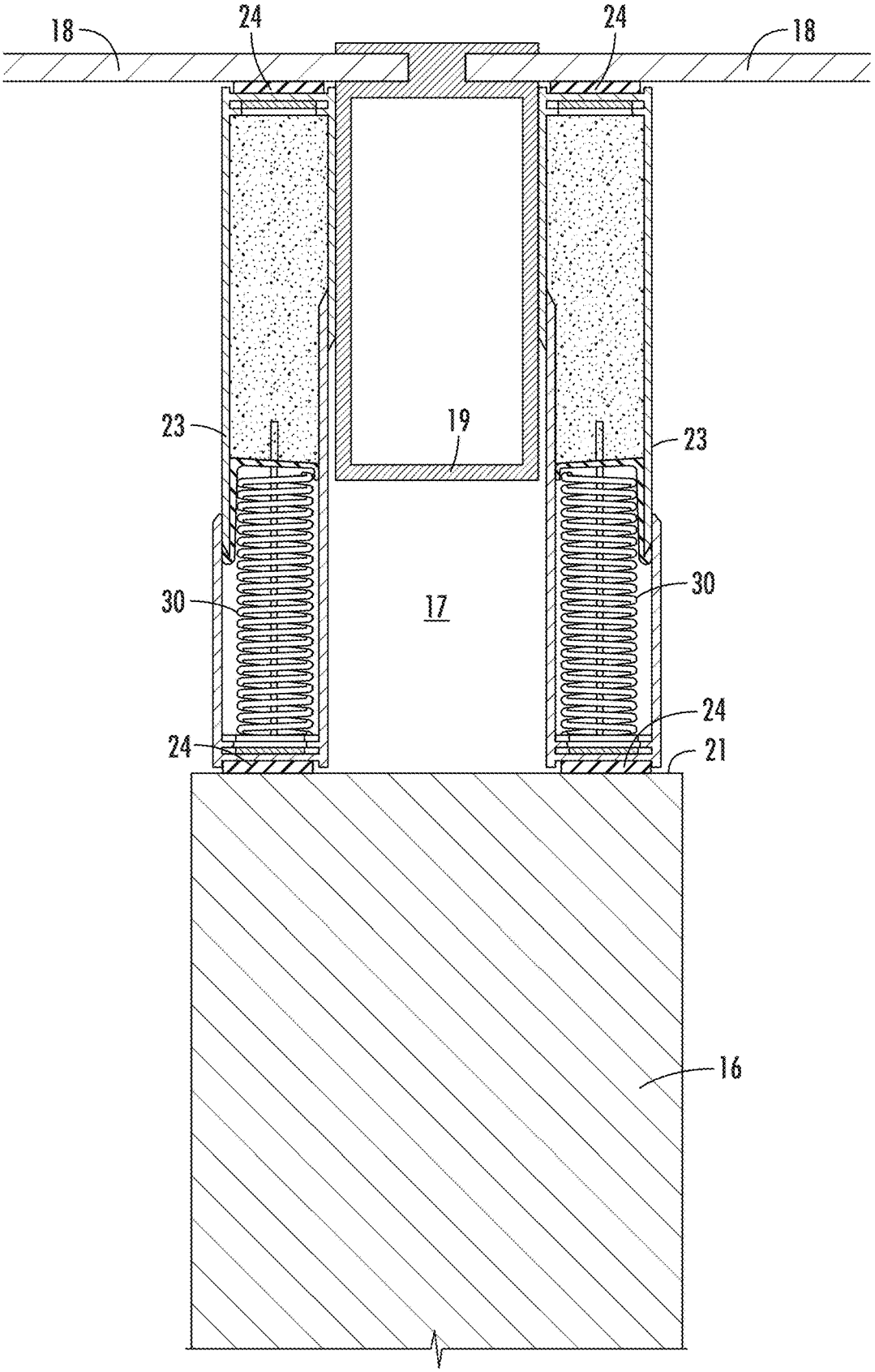
FIG. 3 is a sectional view of an alternate position of the gap filler assembly in use to fill a gap between a wall and a window mullion.

FIGS. 2 and 3 illustrate one embodiment of the gap filling assembly of the present invention used to cover a gap between a window mullion and a partition wall. Specifically, gap filling assemblies 23 extend between glass window panes 18 and end face 21 of the partition wall 16. Each gap filling assemblies 23 is held in this position by an expansive force of the assembly. Additionally, an adhesive on the face of gaskets 24 of gap filling assemblies 23 may help to maintain the assemblies 23 in this position by engaging the surfaces of window panes 18 and end face 21 of partition wall 16. In this embodiment, a gap filling assembly 23 is positioned on each side of window mullion 19. Partition walls 16 may be thicker than standard partition walls for sound proofing purposes. This thickness allows gap filler assemblies 23 to be positioned on both sides of the window mullion 19 without protruding from the side surfaces 22 of partition wall 16. In some embodiments, gap 17 between mullion 19, end face 21 of partition wall 16, and gap filler assemblies 23 may be filled with a sound insulating material for additional sound blocking performance. In other embodiments, a single gap filling assembly 23 may be positioned on one side of the window mullion 19 without a second gap filling assembly 23. In still other embodiments, one or more gap filling assemblies 23 may be positioned to extend between window mullion 19 and end face 21 of partition wall 16. The gap filling assemblies 23 may be positioned such that spring 30 is closer to window panes 18, as shown in FIG. 2, or such that spring 30 is closer to partition wall 16, as shown in FIG. 3. As shown, filling the gap between window panes 18 and partition wall 16 also covers the gap between window mullion 19 and partition wall 16.

Figure 4:
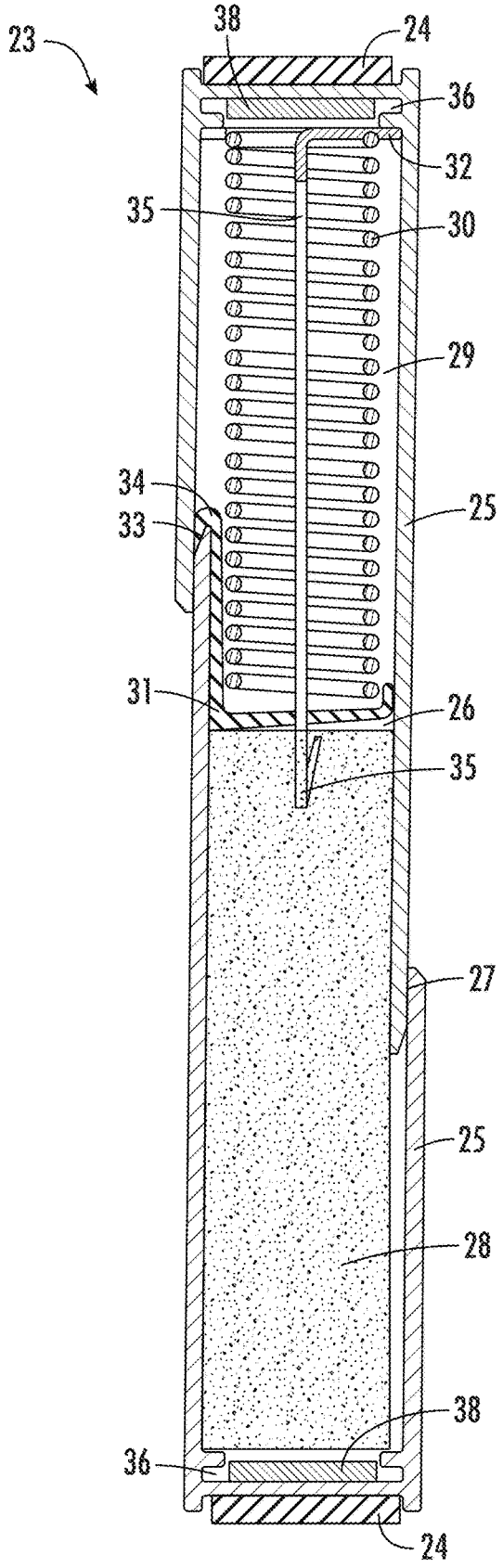
FIG. 4 is a sectional view of one embodiment of the gap filler assembly.

Referring now to FIG. 4, gap filler assembly 23 may include two frame members 25. In some embodiments, each frame member 25 is formed of an aluminum extrusion. The frame members 25 cooperate to define an interior cavity 26, which has a variable volume. The volume of interior cavity 26 is dictated by the amount of engagement or overlap 27 of the two cooperating frame members 25. The interior cavity 26 includes a first portion and a second portion, with the volume of the first portion changing more than the second portion of the interior cavity 26. The second portion of the interior cavity 26 may be filled with sound absorbing insulation 28. The frame members 25 are both urged to move outwards (i.e., in a direction away from the other frame member 25) by the force of compression springs 30 disposed within the first portion of the interior cavity 26. Each spring 30 is supported on a frame member 25. One end of the spring 30 is supported by an upper portion of a spring retainer 35, which is positioned at the deepest portion of one of the U-shaped frame members 25. The second end of the spring 30 is supported by a spring chair 31, which is hung by a hook 34 onto the edge 33 of the opposite frame member 25. The spring 30 is stabilized by the spring retainer 35, which extends through a central portion of the spring 30 and through the spring chair 31 to maintain the spring 30 in the desired position along the gap filler assembly 23. Within interior cavity 26, splice pockets 36 are used to hold metal splices (not shown) to align adjacent frame members 25 when needed on long gaps that exceed the stock length of the frame members 25. In the remaining portions of the gap filler assembly 23, strips of vibration dampening material 38 may be positioned in the splice pockets 36 for attenuation of high frequency noise transmission. The vibration dampening material 38 suppresses the high frequency sound transmitted by the frame members 25, which may be formed of metallic extrusions. The maximum compression of the gap filler assembly 23 is dictated by the spring compression that would cause the top hook 34 of the spring chair 31 to touch the upper portion 32 of the spring retainer 35. The maximum expansion is dictated by the minimum overlap 27 allowed by design. This overlap 27 is controlled by the expansion of spring 30 within the spring retainer 35. This structure traps the spring 30 restricting travel. The springs 30 are spaced along a longitudinal axis or height of the interior cavity 26 to produce the desired force of expansion of the gap filler assembly 23.

Figure 5:
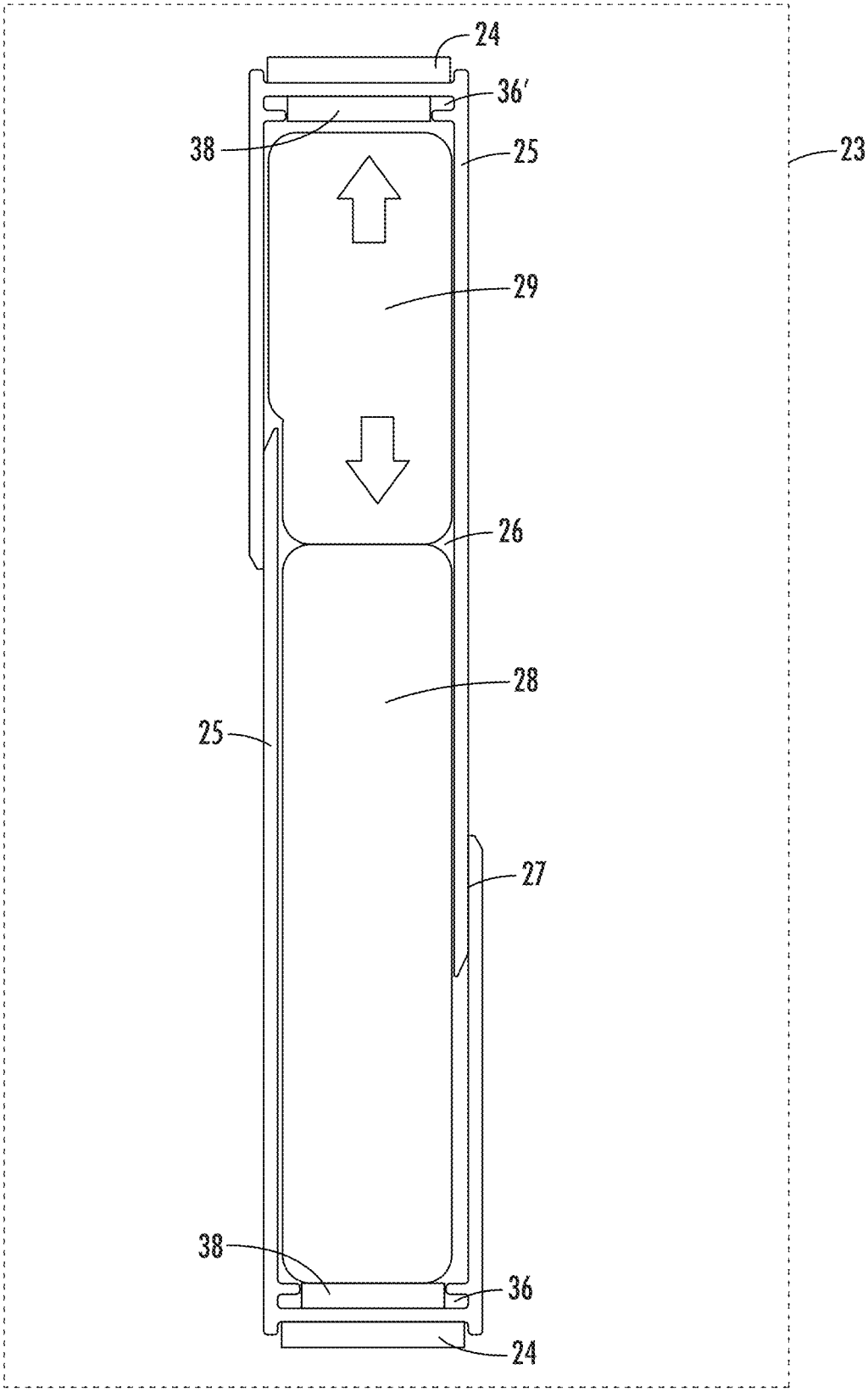
FIG. 5 is a sectional view of the gap filler assembly of FIG. 4 taken at a different point along the length of the assembly.

FIG. 5 illustrates a zone of gap filler assembly 23 between springs 30. Interior cavity 26 may be filled with two types of insulation materials. In certain embodiments, the two types of insulation materials disposed within the interior cavity 26 have different densities. Sound absorbing insulation 28 disposed within a second portion of the interior cavity 26 may comprise a rigid or semi-rigid insulation material aiming to maintain a zone of the interior cavity 26 with a fixed density of insulation that resists compression as the volume of the interior cavity 26 is reduced. The rigid or semi-rigid insulation material provides for ease of assembly and functionality. As used herein, "rigid" in relation to an insulation material means materials having a high density and a high level of rigidity, such as polystyrene, polyisocyanurate, polyurethane, or phenolic materials. As used herein, "semi-rigid" in relation to an insulation material includes insulation panels having fibers secured with a binder, such as fiberglass or mineral (rock or slag) wool.

The variable width of the gap filler assembly 23 is accomplished by the interface of the two frame members 25 moving linearly inside each other (i.e., telescoping). When the frame members 25 move linearly (toward or away from one another), the volume of the interior cavity 26 increases or decreases. In order to ensure that the interior cavity 26 is fully filled with insulating material, the first portion of the interior cavity 26 is filled with a soft and resilient grade of sound proofing insulating material 29. When gap filler assembly 23 is compressed to its minimum width (i.e., along the vertical direction in FIG. 5) and then released to its maximum width, the compressed volume of the insulation material 29 will spring back to fill the expanded interior cavity 26. As used herein, "soft" in relation to an insulation material means an insulation material that compresses when pressure is applied, such as batts and rolls formed of fiberglass, mineral (rock or slag) wool, plastic fibers, or natural fibers.

With reference again to FIG. 5, another embodiment of the gap filler assembly of the present invention contains an expandable foam insulation within interior cavity 26 without any compression springs. In this embodiment, the expandable foam insulation acts as the biasing member that biases the two frame members apart to position and retain the gap filler assembly between an interior wall and an exterior wall or window mullion. As used herein, "biasing member" means any structure, device, or material configured to exert an expansive force on the frame members. The biasing member may be formed of a coil spring, any other type of spring, or an expanding material.

Figure 6:
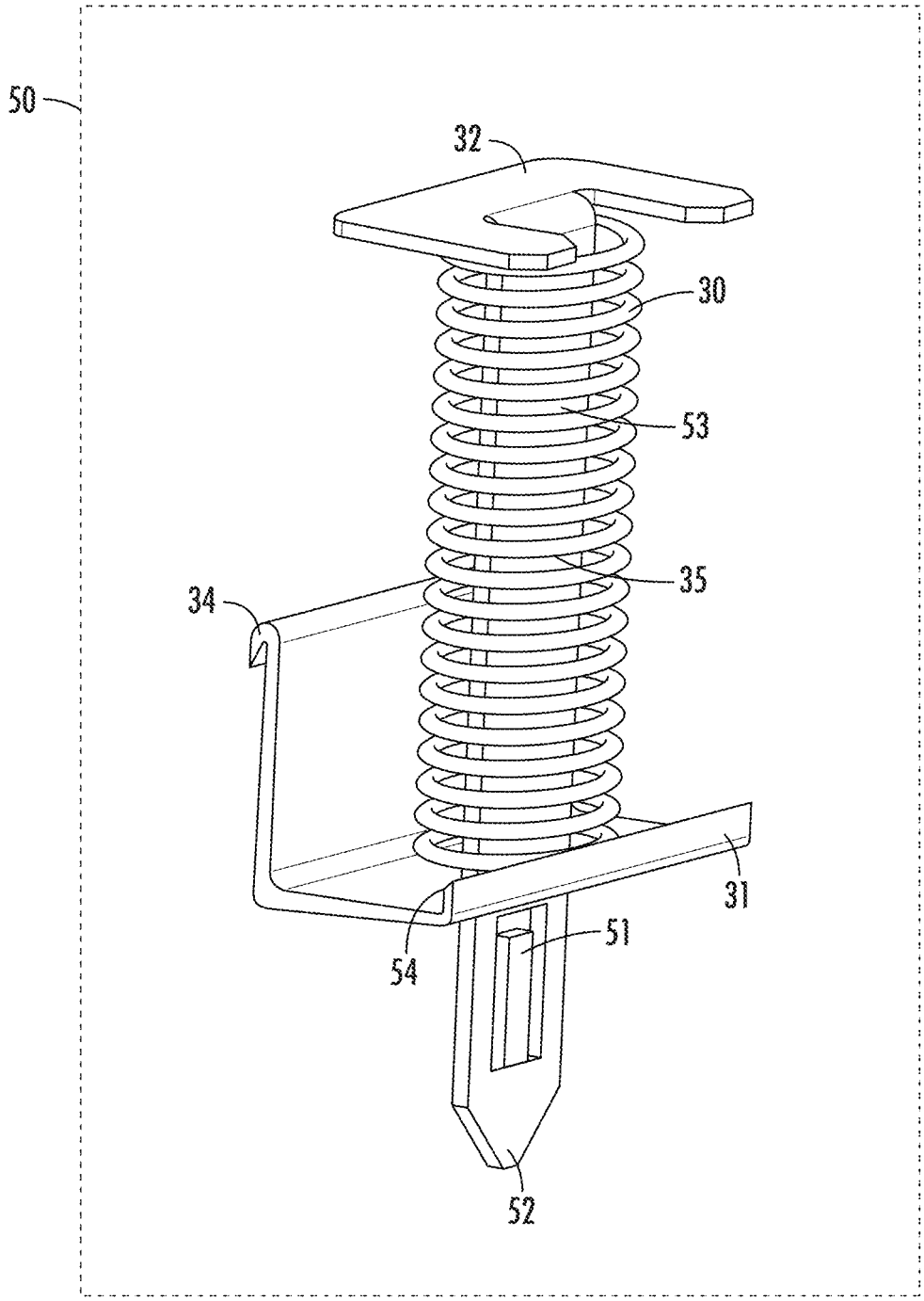
FIG. 6 is a perspective view of a spring assembly of the gap filler assembly of FIG. 4.

FIG. 6 illustrates a spring assembly 50 of the gap filler assembly 23. The spring assembly includes the spring 30, the spring chair 31, and the spring retainer 35. These components are typically joined as a separate assembly to facilitate manufacturing. The spring retainer 35 has a flat head 32 that captures one end of the spring 30. The shape of the spring retainer 35 is dictated by the manufacturing process and the internal width of the frame members 25. The spring retainer 35 has an elongated section 53 that helps to maintain the shape of the spring 30 while compressed. After the spring retainer 35 is inserted through a slot 54 on the spring chair 31, a locking tab 51 is slightly bent to prevent the spring retainer 35 from exiting the slot 54 of the spring chair 31. Holding the spring 30 in a predetermined compressed state allows to the spring 30 to produce a specific spring load over the gap filler assembly 23 at maximum expansion. This configuration also allows for maintaining the gap filler assembly 23 without expanding beyond the minimum gap 27 allowed for functionality and stability of the gap filler assembly 23. The elongated portion 53 of the spring retainer 35, also has a pointed end 52. This pointed end allows the spring retainer 35 to penetrate into the rigid or semi-rigid insulation 28 without obstructing the motion between the frame members 25.

Figure 7:
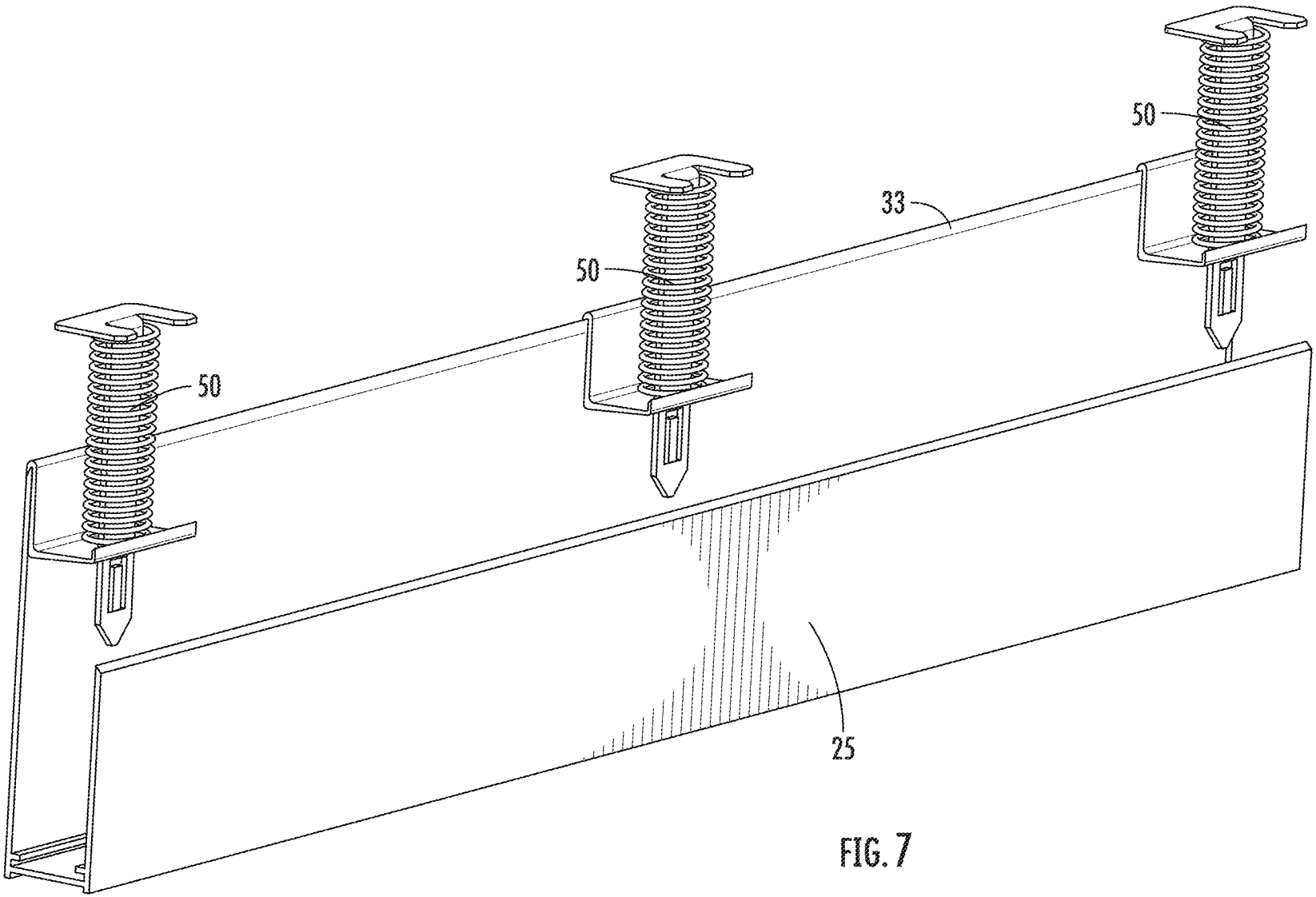
FIG. 7 is a perspective view of spring assemblies positioned along a length of a frame member of the gap filler assembly of FIG. 4.

FIG. 7 shows the positioning of the spring assembly 50 over the top edge 33 of one of the frame members 25. The number of spring assemblies 50 over the length of the gap filler assembly 23 is dictated by the expansion force required to firmly position the gap filler assembly 23 into the desired gap.

Figure 8:
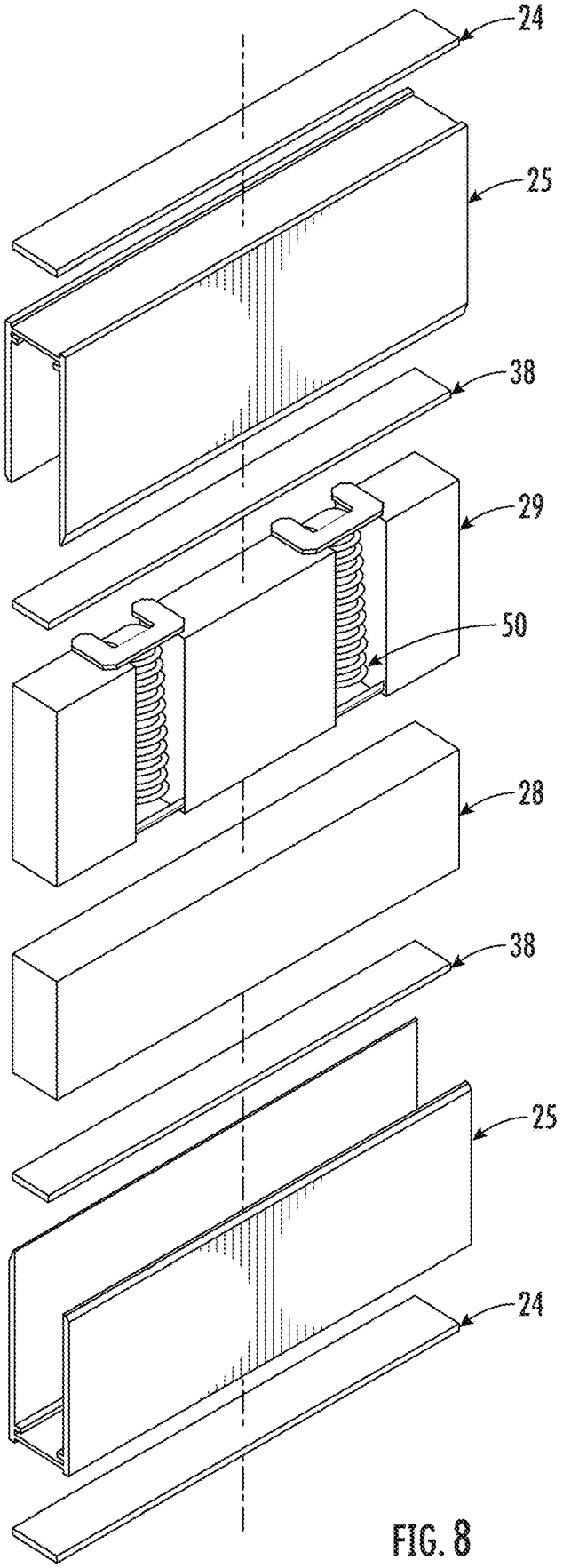
FIG. 8 is an exploded schematic view of the gap filler assembly of FIG. 4.

FIG. 8 illustrates the assembly of the various components of the gap filler assembly. First, vibration dampening material 38 may be positioned within the U-shaped portion of each frame member 25. Soft insulation 29 and spring assemblies 50 may inserted into the first frame member 25. The soft insulation 29 may be disposed between adjacent spring assemblies 50. Rigid or semi-rigid insulation 28 may be inserted into the second frame member 25. Gaskets 24 may be positioned within an outer receptacle of each frame member 25. Finally, the two frame members 25, along with all attached components, may be secured together.

Figure 9:
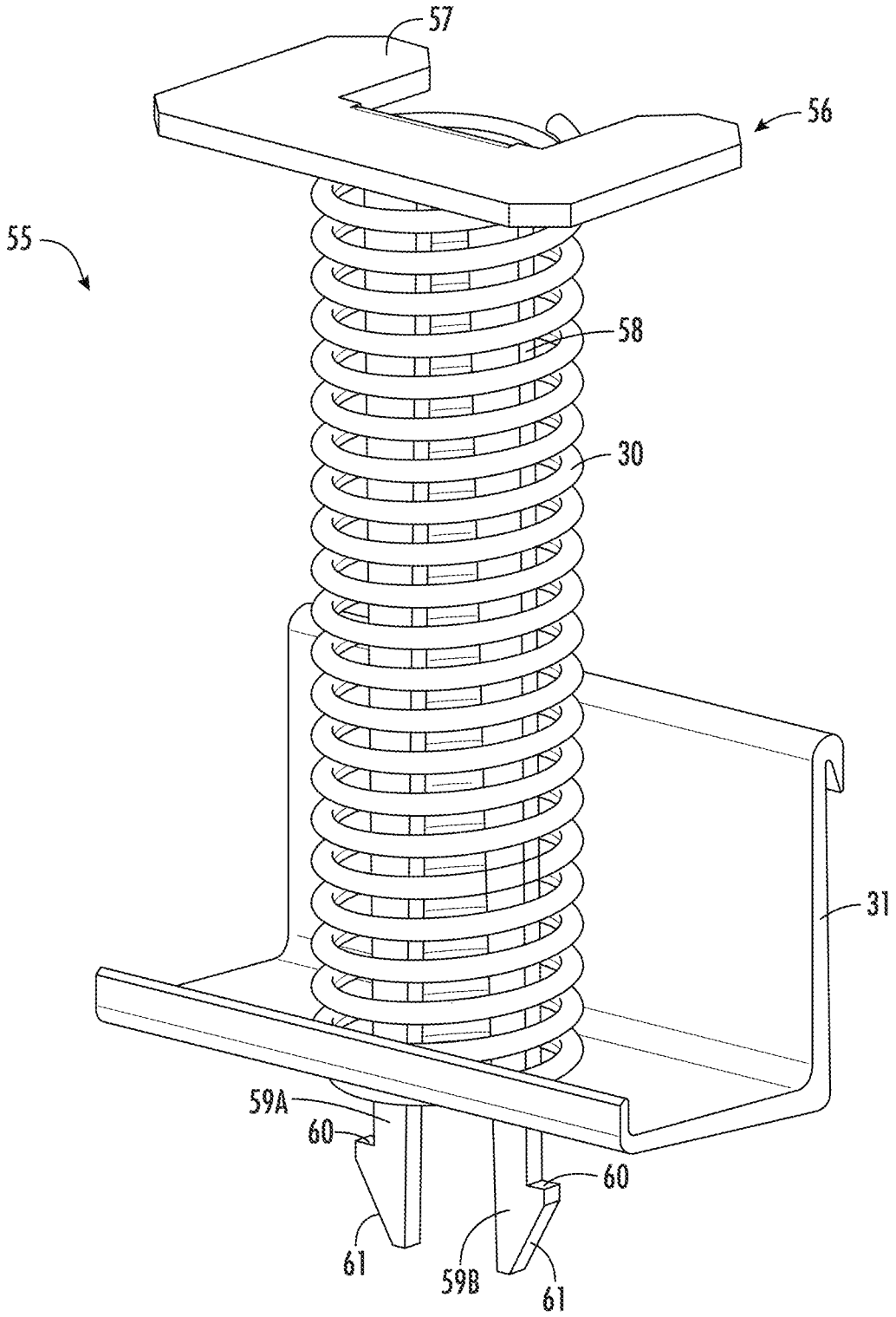
FIG. 9 is a perspective view of a second embodiment of the spring assembly of the gap filler assembly.
Figure 10:
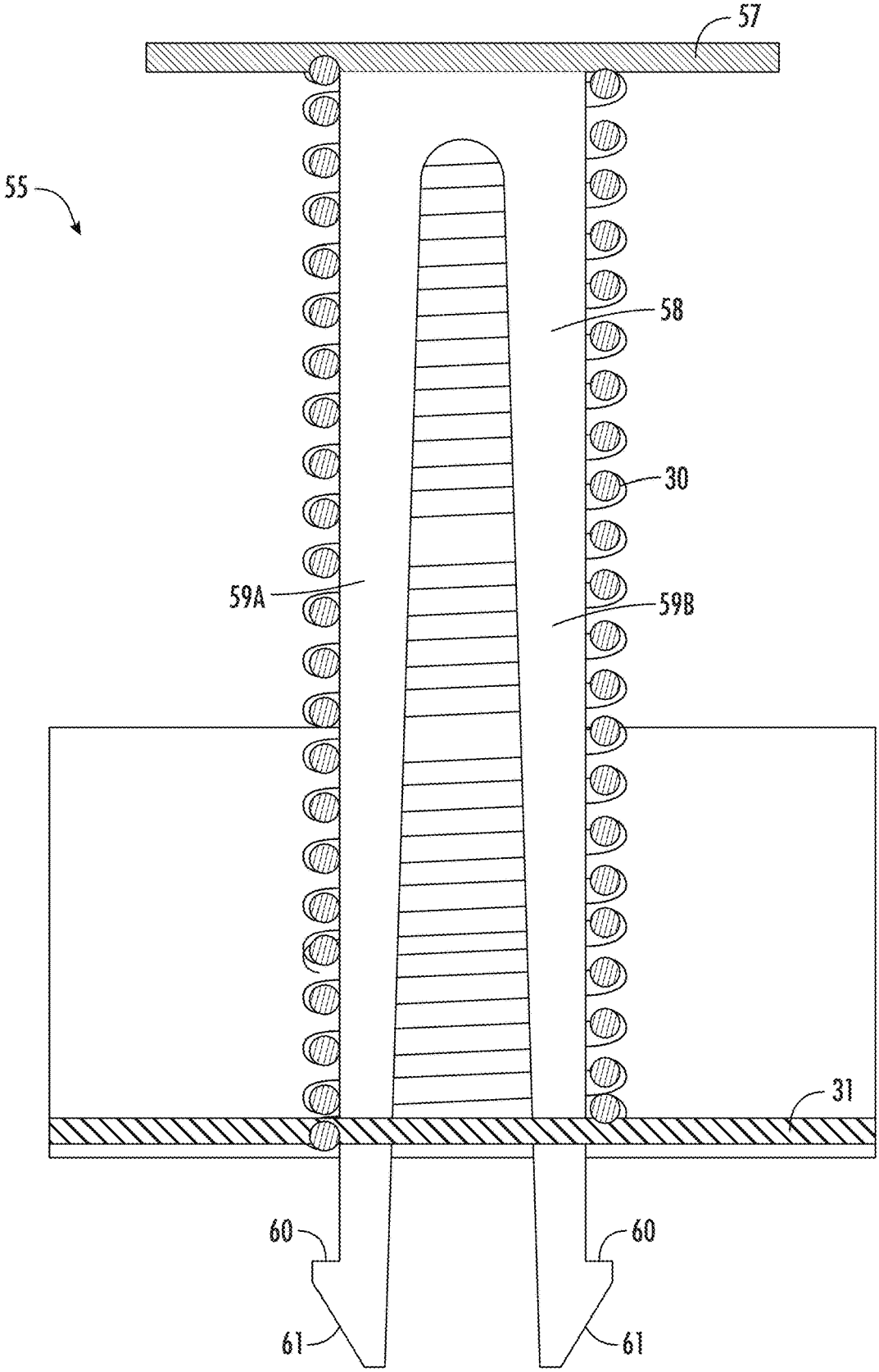
FIG. 10 is a sectional view of the spring retainer assembly of FIG. 9.

With reference to FIGS. 9 and 10, alternate spring assembly 55 includes spring seat 31, spring 30, and spring retainer 56. Spring retainer 56 includes flat upper portion 57 that supports one end of the spring 30. The spring retainer 56 has an elongated section 58 that helps to maintain the shape of the spring 30 while compressed. Elongated section 58 is formed of two spaced apart parallel sections 59A and 59B, each having catch shoulder 60 and a tapered outer profile 61 below catch shoulder 60. As elongated sections 59A and 59B are inserted through a slot in the spring chair 31, tapered outer profiles 61 engage the outer surfaces of the slot to force the lower ends of elongated sections 59A and 59B toward one another. After catch shoulders 60 slide through the slot in spring chair 31, the lower ends of elongated sections 59A and 59B are allowed to move away from each other in order to return to a more relaxed position. In this position, catch shoulders 60 prevents spring retainer 35 from exiting the slot of the spring chair 31. The tapered outer profiles 61 of elongated sections 59A and 59B also allow spring retainer 56 to penetrate into the rigid or semi-rigid insulation without obstructing the motion between the frame members 25. Except as otherwise described, spring assembly 55 has the same features and functions as spring assembly 50.

Figure 11:
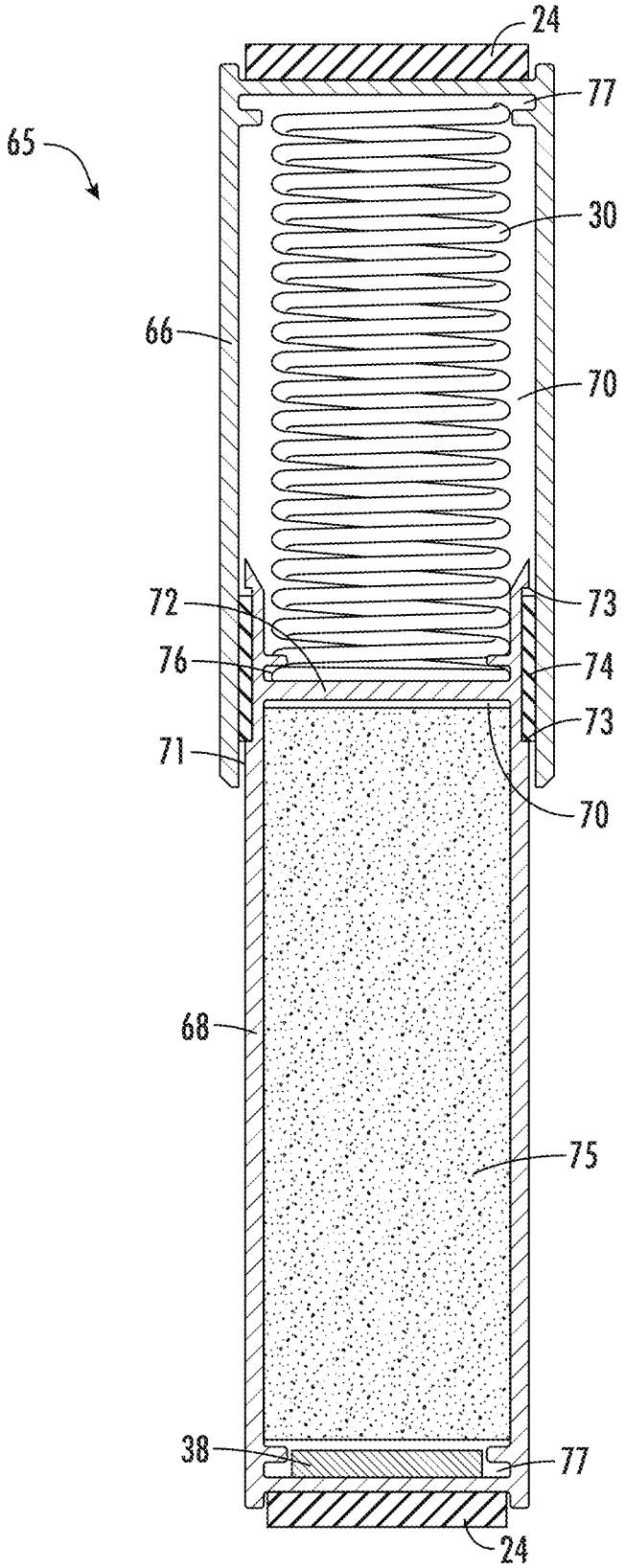
FIG. 11 is a sectional view of a second embodiment of the gap filler assembly of the present invention.
Figure 12:
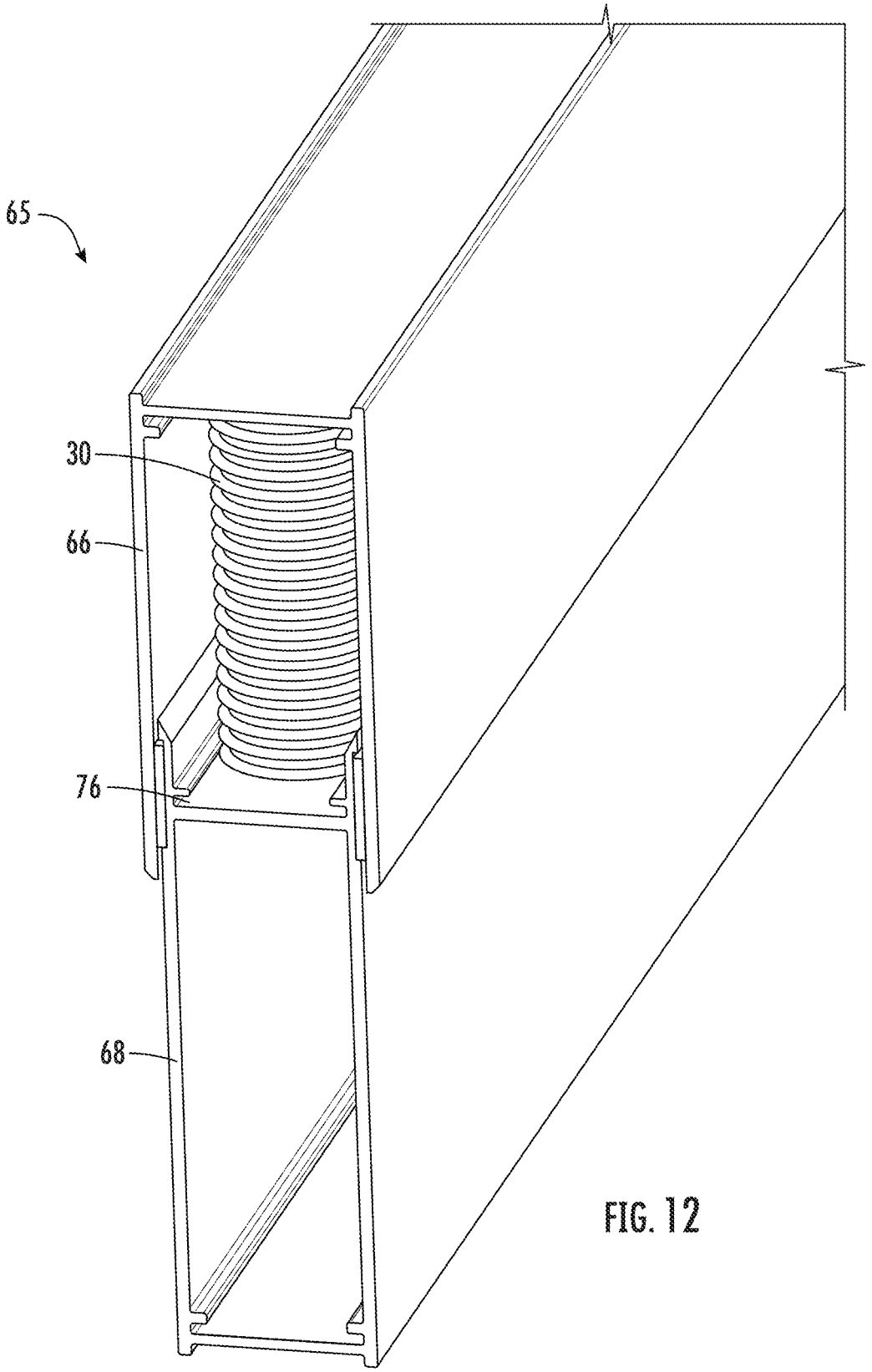
FIG. 12 is a perspective view of the gap filler assembly of FIG. 11.

FIGS. 11-12 illustrate another embodiment of the gap filler assembly of the present invention. Gap filler assembly 65 may include frame members 66 and 68 configured to engage one another to define interior cavity 70, which has a variable volume. The volume of interior cavity 70 is dictated by the amount of overlap 71 of frame members 66 and 68. The interior cavity 70 includes a first portion within frame member 66 and a second portion within frame member 68. In this embodiment, transverse segment 72 of frame member 68 separates the first portion and the second portion of the interior cavity 70. The volume of the first portion changes, while the volume of the second portion remains constant. Frame member 68 may include outer shoulders 73 forming a recessed pocket configured to house an insert, such as vibration insulation material 74 for reducing the transmission of vibrations through assembly 65. Vibration insulation material 74 may also provide a small separation between the proximal end of frame member 66 and the outer surface of frame member 68 to prevent or reduce damage to both frame members 66 and 68 caused by sliding. The second portion of the interior cavity 70 may be filled with sound absorbing insulation 75. Springs 30 are disposed within the first portion of interior cavity 70. The distal end of each spring 30 is supported by a distal end of frame member 66 and the proximal end of each spring 30 is supported by transverse segment 72 of frame member. The proximal end of each spring 30 may be retained within pockets 76 of frame member 66, which are adjacent to transverse segment 72. Splice pockets 77 within the interior cavity 70 of frame members 66 and 68 are configured to hold metal splices for alignment of adjacent frame members. In the remaining portions of the gap filler assembly, strips of vibration dampening material 38 may be placed in splice pockets 77 at the distal ends of the interior cavity 70 to suppress the high frequency sound transmitted by the frame members 66 and 68, which may be formed of metallic extrusions. Gaskets 24 may be positioned on the distal ends of frame members 66 and 68. The maximum compression of the gap filler assembly 65 is dictated by the spring compression that would cause the distal end of frame member 68 to touch the outer surfaces of splice pockets 77 of frame member 66. The maximum expansion is dictated by the minimum overlap 71 allowed by design. The springs 30 are spaced along a longitudinal axis or height of the interior cavity 70 to produce the desired force of expansion of the gap filler assembly.

Figure 13:
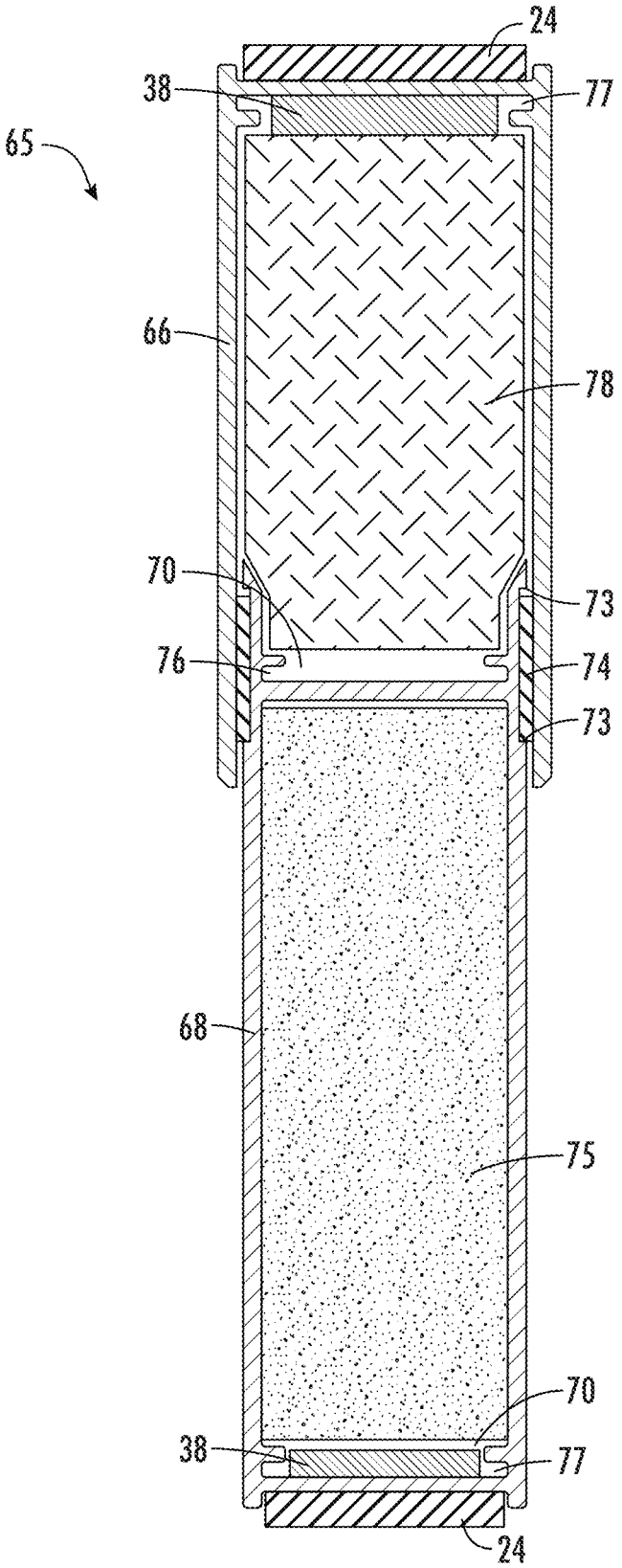
FIG. 13 is a sectional view of the gap filler assembly of FIG. 11 taken at a different point along the length of the assembly.

FIG. 13 illustrates a zone of gap filler assembly 65 between springs 30. Interior cavity 70 may be filled with two types of insulation materials having different densities. Sound absorbing insulation 75 disposed within the second portion of the interior cavity 70 may include a rigid or semi-rigid insulation material that resists compression as the volume of interior cavity 70 is reduced. The variable width of the gap filler assembly 65 is accomplished by the interface of frame members 66 and 68 moving linearly inside one another, which increases or decreases the volume of the first portion of interior cavity 70. The first portion of interior cavity 70 may be filled with a soft and resilient grade of sound proofing insulation 78. When gap filler assembly 65 is compressed to its minimum width and then released to its maximum width, the compressed volume of the insulation 78 will spring back to fill the expanded volume of the first portion of the interior cavity 70. Except as otherwise described, gap filler assembly 65 may include the same features and functions as gap filler assembly 23. Gap filler assembly 65 may be used to cover a gap between an interior partition wall and an exterior wall or window mullion. Springs 30 exert an outward force urging the frame members 66 and 68 into contact with the interior partition wall and the exterior wall or window mullion. In one embodiment, an adhesive on the face of gaskets 24 may help to retain gap filler assembly 65 in this position.

With reference again to FIG. 13, another embodiment of the gap filler assembly of the present invention contains an expandable foam insulation within the first portion of interior cavity 70 without any compression springs. In this embodiment, the expandable foam insulation acts as the biasing member that biases frame members 66 and 68 apart to position to retain the gap filler assembly between an interior wall and an exterior wall or window mullion.

Figure 14:
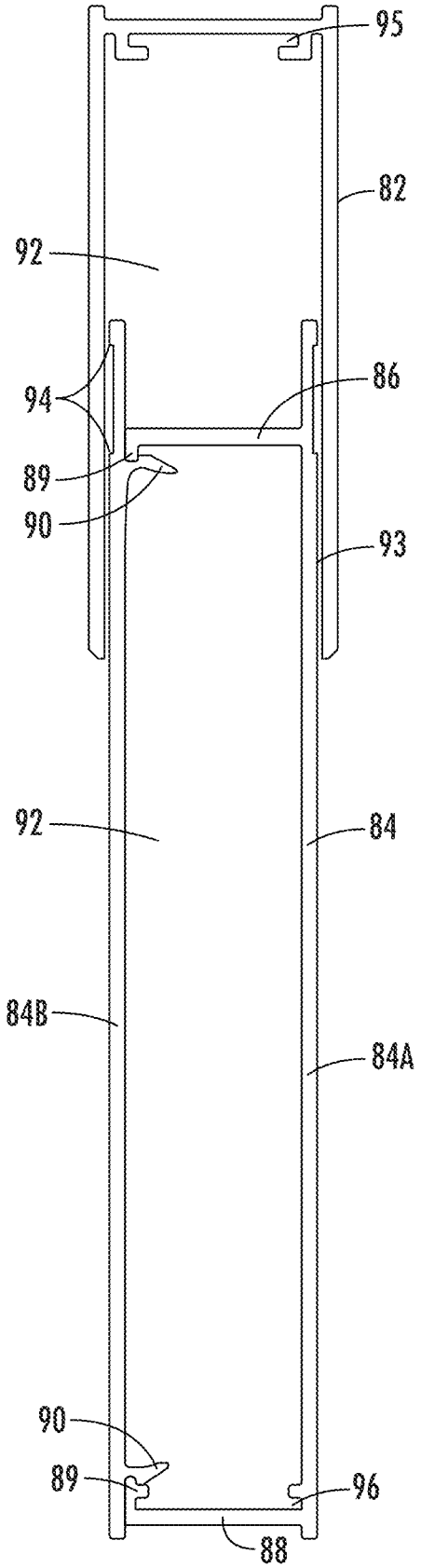
FIG. 14 is a sectional view of a frame of a third embodiment of the gap filler assembly of the present invention.
Figure 15:
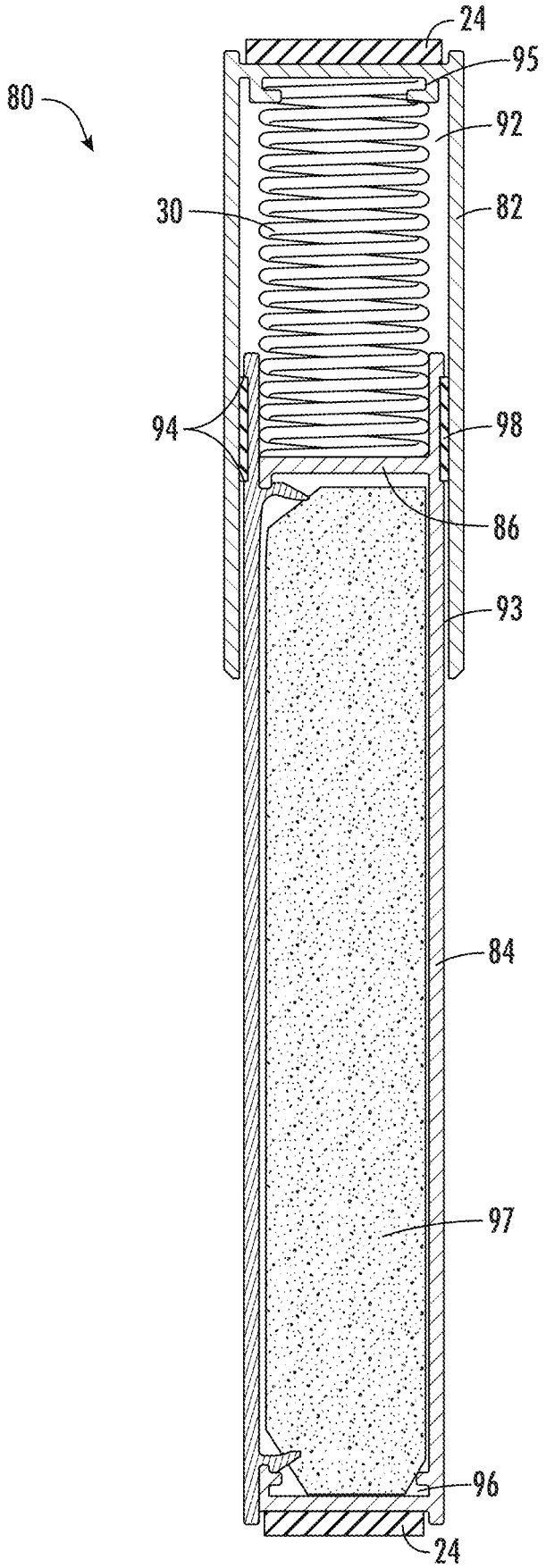
FIG. 15 is a sectional view of the third embodiment of the gap filler assembly including the frame shown in FIG. 14.
Figure 16:
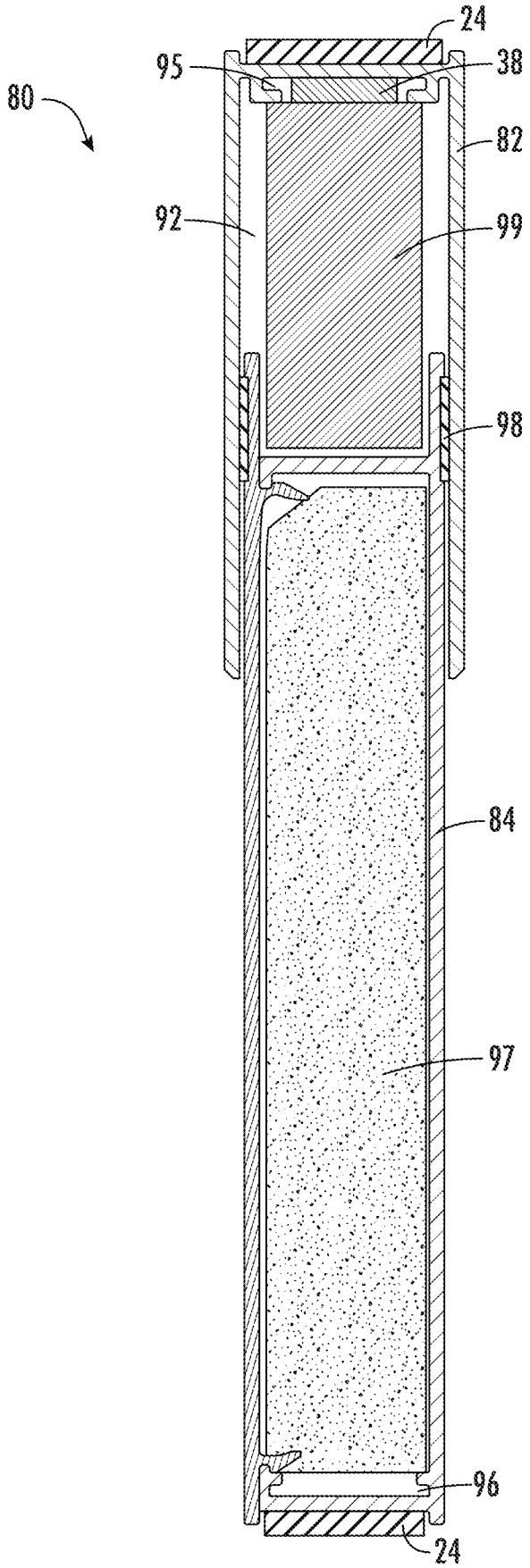
FIG. 16 is a sectional view of the gap filler assembly of FIG. 15 taken at a different point along the length of the assembly.

FIGS. 14-16 illustrate another embodiment of the gap filler assembly of the present invention. As shown in FIG. 14, frame member 82 is configured to engage frame member 84. Frame member 84 is formed of two segments 84A and 84B configured for attachment together. Segment 84A includes a side wall and transverse segments 86 and 88 each including a lip 89. Segment 84B includes a side wall that is parallel to the side wall of segment 84A. Segment 84B also includes two latches 90 configured to engage lips 89 of segment 84A to assemble frame member 84. Frame members 82 and 84 define interior cavity 92 having a variable volume. The volume of interior cavity 92 is dictated by the amount of overlap 93 of frame members 82 and 84. The interior cavity 92 includes a first portion within frame member 82 and a second portion within frame member 84. In the illustrated embodiment, the first and second portions of the interior cavity 92 are separated by transverse segment 86 of frame member 84. The volume of the first portion of the interior cavity 92 changes, while the volume of the second portion remains constant. Frame member 84 may include outer shoulders 94 forming a recessed pocket configured to house an insert. Frame member 82 includes splice pockets 95 at a distal end of the first portion of the interior cavity 92. Similarly, frame member 84 includes splice pockets 96 at a distal end of the second portion of the interior cavity 92.

Referring now to FIGS. 15 and 16, gap filler assembly 80 includes frame members 82 and 84 with springs 30 disposed within the first portion of the interior cavity 92. Each spring 30 is supported by the distal end of frame member 82 and transverse segment 86 of frame member 84. The distal end of each spring 30 is retained within splice pockets 95 of frame member 82. The second portion of the interior cavity 92 may be filled with sound absorbing insulation 97. The configuration of frame member 84 in two segments 84A and 84B eases the process of inserting insulation 97 into the second portion of interior cavity 92. Gap filler assembly 80 may also include vibration insulation material 98 in the recessed pockets formed by outer shoulders 94 of frame member 84. Vibration insulation material 98 may provide a small separation between frame members 82 and 84 at overlap 93. Splice pockets 95 and 96 are configured to hold metal slices for alignment of adjacent frame members. In the remaining portions of the gap filler assembly 80, strips of vibration dampening material 38 may be placed in splice pockets 95 and 96. The maximum compression of gap filler assembly 80 is dictated by the spring compression that would cause the distal end of frame member 84 to touch the outer surfaces of splice pockets 95 of frame member 82. The maximum expansion is dictated by the minimum overlap 93 allowed by design. The springs 30 are spaced along a longitudinal axis or height of the interior cavity 92.

FIG. 16 illustrates a zone of gap filler assembly 80 between springs 30. Interior cavity 92 may be filled with two types of insulation materials having different densities. Insulation 97 within the second portion of the interior cavity 92 may include a rigid or semi-rigid insulation material that resists compression as the volume of interior cavity 92 is reduced. The first portion of the interior cavity 92 may be filled with a soft and resilient grade of sound proofing insulation 99, which may spring back to fill up an expanded volume of the first portion of the interior cavity 92 when the volume is increased after being decreased. Except as otherwise described, gap filler assembly 80 may include the same features and functions as gap filler assembly 23. Gap filler assembly 80 may be used to cover a gap between an interior partition wall and an exterior wall or window mullion. Springs 30 exert an outward force urging the frame members 82 and 84 into contact with the interior partition wall and the exterior wall or window mullion.

With reference again to FIG. 16, another embodiment of the gap filler assembly of the present invention contains an expandable foam insulation within the first portion of interior cavity 92 without any compression springs. In this embodiment, the expandable foam insulation acts as the biasing member that biases frame members 82 and 84 apart to position and retain the gap filler assembly between an interior wall and an exterior wall or window mullion.

Figure 17:
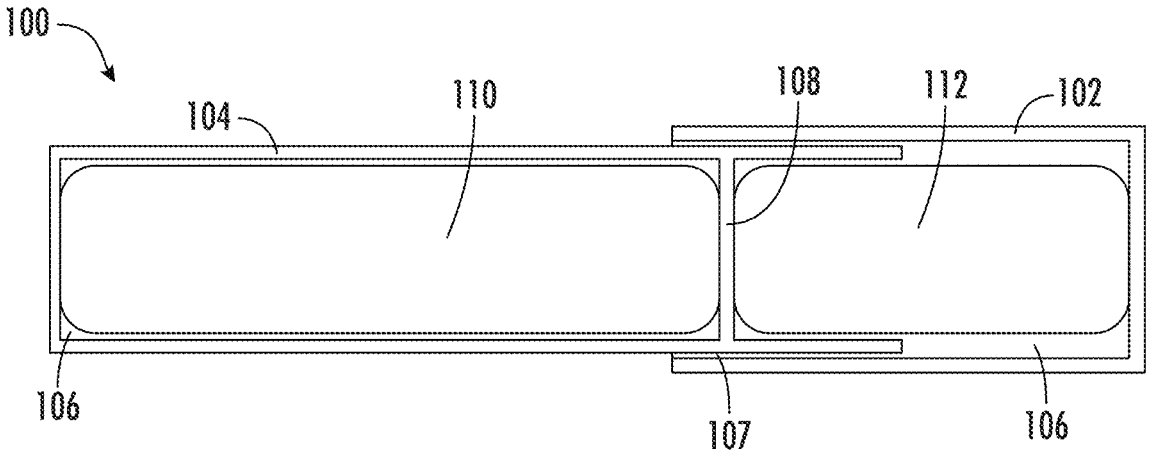
FIG. 17 is a sectional view of a fourth embodiment of the gap filler assembly of the present invention.
Figure 18:
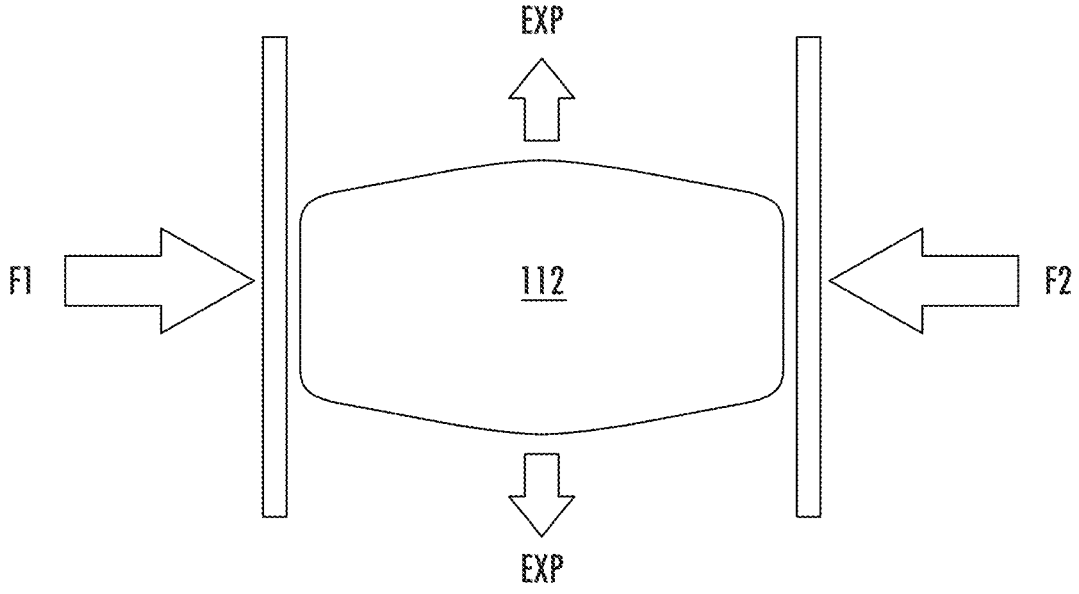
FIG. 18 is a schematic representation of the behavior of insulating foam of the gap filler assembly of FIG. 17 in response to compression.
Figure 19:
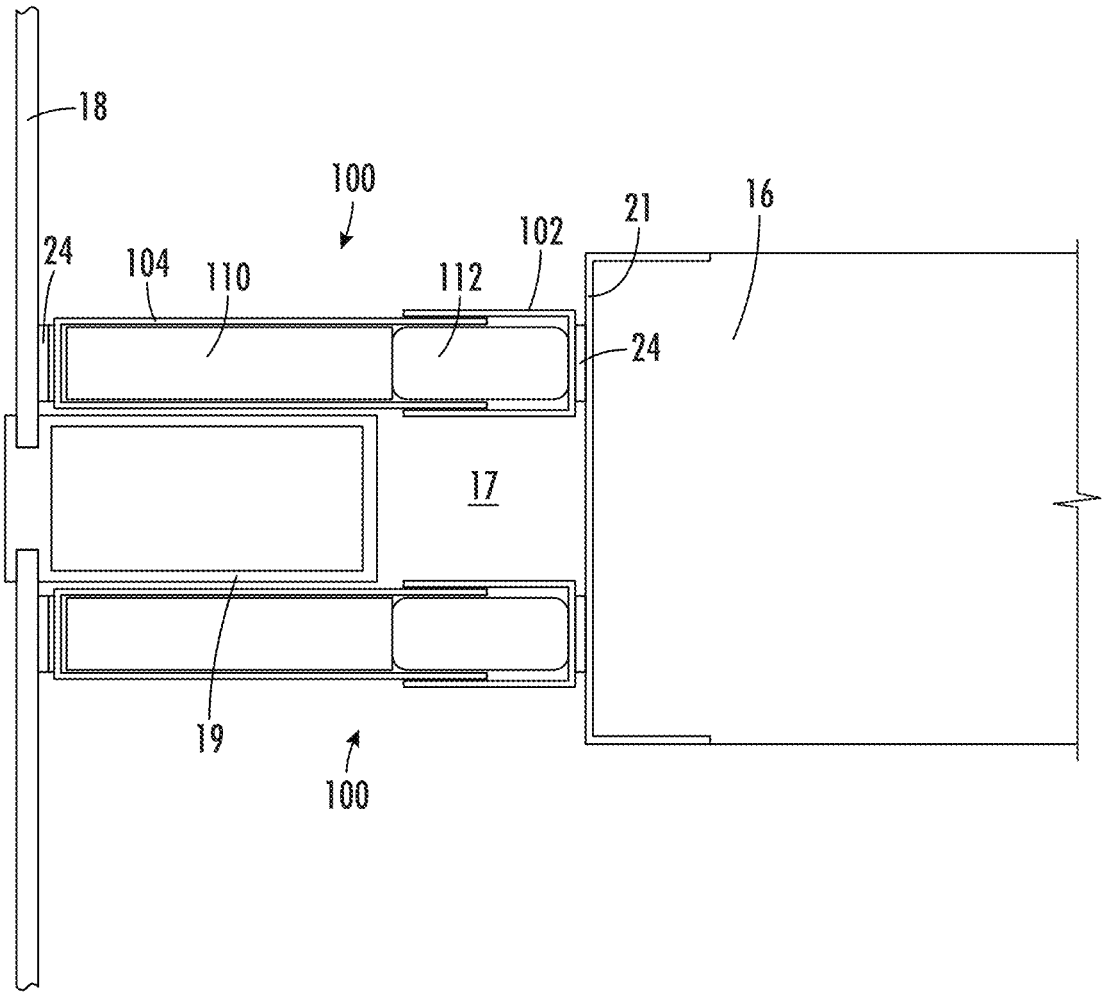
FIG. 19 is a sectional view of the gap filler assembly of FIG. 17 in use to fill a gap between a wall and a window mullion.

FIGS. 17-19 illustrate yet another embodiment of the gap filler assembly of the present invention. With reference to FIG. 17, gap filler assembly 100 includes frame members 102 and 104 configured to engage one another to define interior cavity 106, which has a variable volume. The volume of interior cavity 106 is dictated by the amount of overlap 107 of frame members 102 and 104. The interior cavity 106 includes a first portion within frame member 102 and a second portion within frame member 104. In this embodiment, transverse segment 108 of frame member 104 separates the first portion and the second portion of the interior cavity 106. The volume of the first portion changes, while the volume of the second portion remains constant. Two types of insulation materials having different densities are disposed within the first and second portions of the interior cavity 106. The second portion of the interior cavity 106 is filled with a rigid or semi-rigid sound absorbing insulation 110 that resists compression and does not expand laterally. The first portion of the interior cavity 106 houses an expandable foam insulation 112. The expandable insulation 112 exerts an expansive force that urges the frame members 102 and 104 to move apart. It must be understood that when the insulating foam 112 is compressed, it also applies pressure over the side walls of the frame members, which is the reason that the assembly's expanding force is linear when the lateral friction created by the lateral expansion is small. Since the insulating foam 112 behaves as a Newtonian fluid, it is expected that when compressed in one direction, there are deformations in all directions. For this reason, the ratio of foam length over foam width should be maintained within certain limits. FIG. 18 illustrates this property of the insulating foam 112 when it is subjected to unidirectional compression. As in any Newtonian fluid, when unidirectional compressive forces F1 and F2 are applied over the insulating foam 112, lateral expanding deformation occurs. When the ratio foam length/width is larger than 4, the lateral expansion creates frictional forces against the walls of the interior cavity 106. This frictional force negatively affects the elastic deformation of the foam section.

FIG. 19 illustrates two gap filler assemblies 100 used to cover gap 17 between window mullion 19 and partition wall 16. The gap filler assemblies 100 are positioned between the glass window panes 18 and the end face 21 of partition wall 16. Gaskets 24 are positioned at the ends of frame members 102 and 104 to seal small voids and to secure the gap filler assemblies 100 in place. Gap filler assemblies 100 are held in position by the expansive force of the foam insulation 112 and by the adhesive on the face of the gaskets 24. Gap filler assemblies 100 may be narrow enough to fit between the two side surfaces of partition wall 16. Due to the large ratio of the foam length/foam width, a reasonable section of expandable foam insulation 112 is used to avoid excessive lateral expansive forces.

Figure 20:
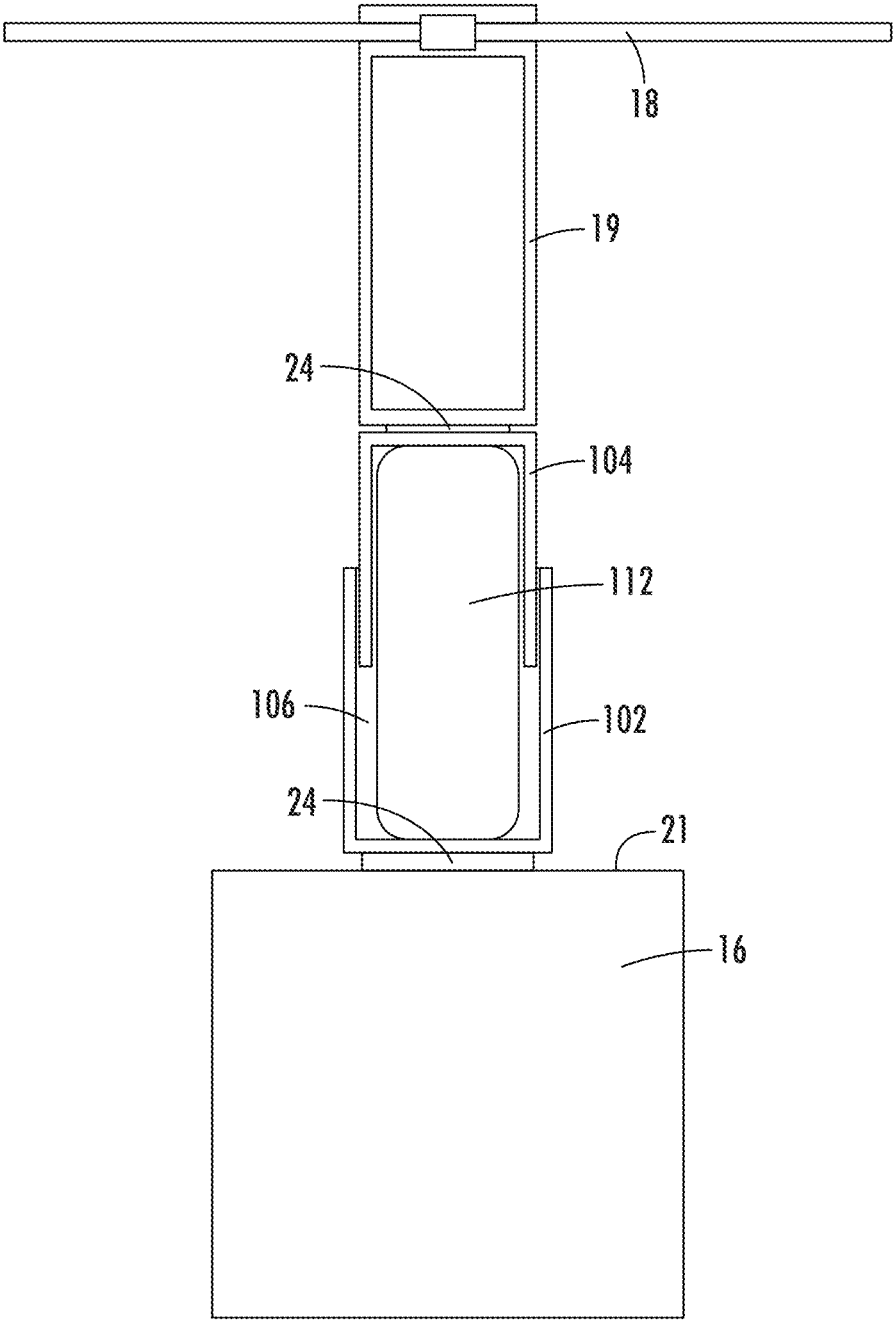
FIG. 20 is a sectional view of an alternate position of the gap filler assembly of the FIG. 17 in use to fill a gap between a wall and a window mullion.

FIG. 20 illustrates a variation of gap filler assembly 100 in use to fill a gap between partition wall 16 and window mullion 19. In this variation, frame member 104 does not include a transverse segment such that interior cavity 106 includes a single open space. Expandable foam insulation 112 is disposed within the interior cavity 106 and exerts the outward expansive force directly on the distal ends of the frame members 102 and 104. FIG. 20 illustrates positioning this variation of gap filler assembly 100 directly between the window mullion 19 and the end face 21 of the partition wall 16.

As the skilled in the art will recognize, where the frame members 102 and 104 are manufactured using the aluminum extrusion process, channels that are too deep in relation to their width are very difficult to maintain within the required tolerances for the assembly. Keeping in mind that restriction, it is necessary to use extrusions that are fairly stable during processing. Frame member 104 is constructed as a partial enclosed cavity 106 where an insulating material 110 is placed inside the cavity 106. By means of this type of construction, the telescoping section of the gap filler assembly could be maintained within the limits allowed by the resilient insulating foam 112 within the frame member 102 and the open portion of the frame member 104. Except as otherwise described, gap filler assembly 100 includes the same features and functions as gap filler assembly 23.

The present invention may of course be carried out in other specific ways than those set forth herein without departing from the scope and the essential characteristics of the invention previously described. The present embodiments are therefore to be construed in all aspects as illustrative and not restrictive and all changes coming within the meaning and equivalency range of the appended claims are intended to be embraced herein.

Except as otherwise described or illustrated, each of the components in this device may be formed of aluminum, steel, another metal, plastic, or any other durable, natural or synthetic material. Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. Plurality means two or more.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

I claim:

1. A gap filler assembly for filling or covering a gap between an interior partition wall and an exterior wall of a building structure, the gap filling assembly comprising:

a) a first frame member slidingly engaging a second frame member;

b) an interior cavity defined by the first and second frame members, wherein the interior cavity has a variable volume, and wherein the interior cavity includes a first portion within the first frame member and a second portion within the second frame member;

c) expandable foam sound insulation disposed within the first portion of the interior cavity, wherein the expandable foam sound insulation is configured to exert a force on the first frame member in a direction away from the second frame member for compressing the first and second frame members between the interior partition wall and the exterior wall; and d) a rigid or semi-rigid sound insulation material disposed within the second portion of the interior cavity.

2. The gap filler assembly of claim 1, wherein the first and second frame members are formed of metallic extrusions.

3. The gap filler assembly of claim 1, wherein the second frame member further includes a transverse segment separating the first and second portions of the interior cavity.

4. The gap filler assembly of claim 1, wherein the second frame member includes recesses in its exterior surfaces configured to receive the insulating material within the overlap between the first and second frame members.

5. The gap filler assembly of claim 1, wherein the second frame member is formed of two interlocking segments.

6. The gap filler assembly of claim 1, wherein the first and second frame members each include splice pockets configured to receive metal splices for aligning adjacent frame members.

7. The gap filler assembly of claim 6, further comprising a vibration dampening material disposed within a portion of the splice pockets in the first and second frame members.

8. A method of filling a gap between an interior partition wall and an exterior wall of a building structure, comprising the steps of:

a) providing a gap filling assembly comprising: a first frame member slidingly engaging a second frame member; an interior cavity defined by the first and second frame members, wherein the interior cavity has a variable volume and includes a first portion within the first frame member and a second portion within the second frame member; expandable foam sound insulation disposed within the first portion of the interior cavity; and a rigid or semi-rigid sound insulation material disposed within the second portion of the interior cavity; and b) positioning the gap filling assembly between the interior partition wall and the exterior wall, wherein the biasing member exerts a force on the first frame member in a direction away from the second frame member to retain the gap filling assembly in this position.

* * * * *